US008232950B2

(12) United States Patent
Cha et al.

(10) Patent No.: US 8,232,950 B2
(45) Date of Patent: Jul. 31, 2012

(54) LIQUID CRYSTAL DISPLAY AND METHOD OF DRIVING THE SAME CAPABLE OF INCREASING DISPLAY QUALITY BY PREVENTING POLARITY LEAN OF DATA

(75) Inventors: Donghoon Cha, Gumi-si (KR); Suhyuk Jang, Daegu (KR); Hwanjoo Lee, Daegu (KR)

(73) Assignee: LG Display Co., Ltd., Seoul (KR)

( * ) Notice: Subject to any disclaimer, the term of this patent is extended or adjusted under 35 U.S.C. 154(b) by 963 days.

(21) Appl. No.: 12/248,454

(22) Filed: Oct. 9, 2008

(65) Prior Publication Data

US 2009/0251451 A1 Oct. 8, 2009

(30) Foreign Application Priority Data

Apr. 8, 2008 (KR) ..... 10-2008-0032638

(51) Int. Cl.
*G09G 3/36* (2006.01)

(52) U.S. Cl. ..... 345/96; 345/209

(58) Field of Classification Search ..... 345/87–102, 345/209, 214

See application file for complete search history.

(56) References Cited

U.S. PATENT DOCUMENTS

| | | | | |
|---|---|---|---|---|
| 5,892,494 | A * | 4/1999 | Kimura et al. | 345/96 |
| 6,384,807 | B1 * | 5/2002 | Furuhashi et al. | 345/96 |
| 2004/0070581 | A1 * | 4/2004 | Hiraki et al. | 345/209 |
| 2008/0211802 | A1 * | 9/2008 | Yun et al. | 345/214 |

FOREIGN PATENT DOCUMENTS

| | | | |
|---|---|---|---|
| JP | 2000235375 | A | 8/2000 |
| JP | 2008286869 | A | 11/2008 |

OTHER PUBLICATIONS

Office Action issued in corresponding Japanese Patent Application No. 2008-261217, mailed Aug. 3, 2011.

* cited by examiner

*Primary Examiner* — Chanh Nguyen
*Assistant Examiner* — James Nokham
(74) *Attorney, Agent, or Firm* — Brinks Hofer Gilson & Lione

(57) ABSTRACT

A liquid crystal display and a method of driving the same are disclosed. The liquid crystal display includes a liquid crystal display panel including data lines and gate lines crossing each other, and liquid crystal cells arranged in a matrix forma, a horizontal polarity controller that compares digital video data with a critical value and inverts a logic state of a horizontal polarity conversion signal when polarities of the digital video data lean based on the comparative result, a data drive circuit that converts the digital video data into positive and negative data voltages and controls horizontal polarity inversion periods of the data voltages in response to the horizontal polarity conversion signal, and a gate drive circuit that supplies scan signals to the gate lines.

12 Claims, 12 Drawing Sheets

LIQUID CRYSTAL DISPLAY AND METHOD OF DRIVING THE SAME CAPABLE OF INCREASING DISPLAY QUALITY BY PREVENTING POLARITY LEAN OF DATA

This application claims the benefit of Korea Patent Application No. 10-2008-0032638 filed on Apr. 8, 2008, which is incorporated herein by reference for all purposes as if fully set forth herein.

BACKGROUND OF THE INVENTION

1. Field of the Invention

An exemplary embodiment of the invention relate to a liquid crystal display and a method of driving the same.

2. Discussion of the Related Art

Active matrix type liquid crystal displays display a moving picture using a thin film transistor (TFT) as a switching element. The active matrix type liquid crystal displays have been implemented in televisions as well as display devices in portable devices, such as office equipment and computers, because of the thin profile of the active matrix type liquid crystal displays. Accordingly, cathode ray tubes (CRT) are being replaced by active matrix type liquid crystal displays.

As shown in FIG. 1, a test pattern may be used in an inspection process for inspecting the image quality of a liquid crystal display. In the inspection process, after a striped pattern, in which pixels charged to a white gray level voltage and pixels charged to a black gray level voltage are alternately positioned, is applied to the liquid crystal display and the liquid crystal display displays the striped pattern for a predetermined period of time, a voltage applied to pixels in a middle area of a display screen of the liquid crystal display is adjusted at an intermediate gray level voltage between the white gray level voltage and the black gray level voltage. As a result, a common voltage shifts depending on a location of the screen, and thus crosstalk occurs. This is because the common voltage applied to a common electrode of a liquid crystal cell shifts depending on changes in a data voltage applied to a pixel electrode of the liquid crystal cell by a coupling between the pixel electrode and the common electrode.

A polarity of the data voltage applied to the liquid crystal display is periodically inverted so as to suppress a direct current (DC) drive of a liquid crystal. When the liquid crystal display displays the test pattern shown in FIG. 1, polarities of the data voltages are shown in FIG. 2. FIG. 2 shows polarities of the data voltages in a portion of the test pattern of FIG. 1. The data voltages of the test pattern are inverted according to a horizontal and vertical 1 dot inversion scheme used when a general image is input. In the horizontal and vertical 1 dot inversion scheme, polarities of the data voltages supplied to neighboring liquid crystal cells in a horizontal direction are opposite to each other, and polarities of the data voltages supplied to neighboring liquid crystal cells in a vertical direction are opposite to each other. If polarities of the data voltages of the test pattern shown in FIG. 1 are inverted according to the horizontal and vertical 1 dot inversion scheme, a greenish phenomenon in which green cells are brightly seen occurs, and a luminance difference between neighboring lines occurs. This is because the polarities of the data voltages charged to the liquid crystal display lean to any one polarity. This will be described with reference to FIGS. 3 and 4.

As shown in FIG. 3, in the pixels on A-line to which the white data voltage is applied, polarities of R-data voltage and B-data voltage are a positive polarity, and a polarity of G-data voltage is a negative polarity. Accordingly, in the A-line, the positive data voltage is more dominant than the negative data voltage. As a result, a ripple of a common voltage Vcom in the A-line increases toward a positive polarity, and thus the common voltage Vcom shifts toward the positive polarity. Further, because the G-data voltage, that is applied as a positive black voltage +Vblack during a previous frame period, changes to a negative white voltage −Vwhite during a current frame period, a voltage difference between the G-data voltages during the neighboring frame periods increases. Therefore, the greenish phenomenon appears.

As shown in FIG. 4, in the pixels on B-line to which the white data voltage is applied, polarities of the R-data voltage and the B-data voltage are a negative polarity, and a polarity of the G-data voltage is a positive polarity. Accordingly, in the B-line, the negative data voltage is more dominant than the positive data voltage. As a result, a ripple of the common voltage Vcom in the B-line increases toward a negative polarity, and thus the common voltage Vcom shifts toward the negative polarity. Further, because the G-data voltage, that is applied as a negative black voltage −Vblack during a previous frame period, changes to a positive white voltage +Vwhite during a current frame period, a voltage difference between the G-data voltages during the neighboring frame periods increases. Therefore, the greenish phenomenon appears.

When the data voltages (for example, the white voltage and the black voltage) with a large voltage difference therebetween are applied to the neighboring pixels, the greenish phenomenon, a smear phenomenon, and the crosstalk occur in the related art liquid crystal display because the data voltages lean to any one polarity. Accordingly, the display quality of the related art liquid crystal display is reduced in the data of some weak patterns.

SUMMARY

An exemplary embodiment of the invention provides a liquid crystal display and a method of driving the same capable of increasing the display quality by preventing that polarities of data lean to any one polarity.

Additional features and advantages of the exemplary embodiments of the invention will be set forth in the description which follows, and in part will be apparent from the description, or may be learned by practice of the exemplary embodiments of the invention. The objectives and other advantages of the exemplary embodiments of the invention will be realized and attained by the structure particularly pointed out in the written description and claims hereof as well as the appended drawings.

In one aspect, a liquid crystal display comprises a liquid crystal display panel including data lines and gate lines crossing each other, and liquid crystal cells arranged in a matrix format, a horizontal polarity controller that compares digital video data with a critical value and inverts a logic state of a horizontal polarity conversion signal when polarities of the digital video data lean based on the comparative result, a data drive circuit that converts the digital video data into positive and negative data voltages and controls horizontal polarity inversion periods of the data voltages in response to the horizontal polarity conversion signal, and a gate drive circuit that supplies scan signals to the gate lines.

In another aspect, a method of driving a liquid crystal display including a liquid crystal display panel including data lines and gate lines crossing each other and liquid crystal cells arranged in a matrix format, the method comprises comparing digital video data with a critical value and inverting a logic state of a horizontal polarity conversion signal when polarities of the digital video data lean based on the comparative result, converting the digital video data into positive and negative data voltages and differently controlling horizontal polarity inversion periods of the data voltages in response to the horizontal polarity conversion signal, and supplying scan signals to the gate lines.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail embodiments of the invention examples of which are illustrated in the accompanying drawings.

Figure 1:
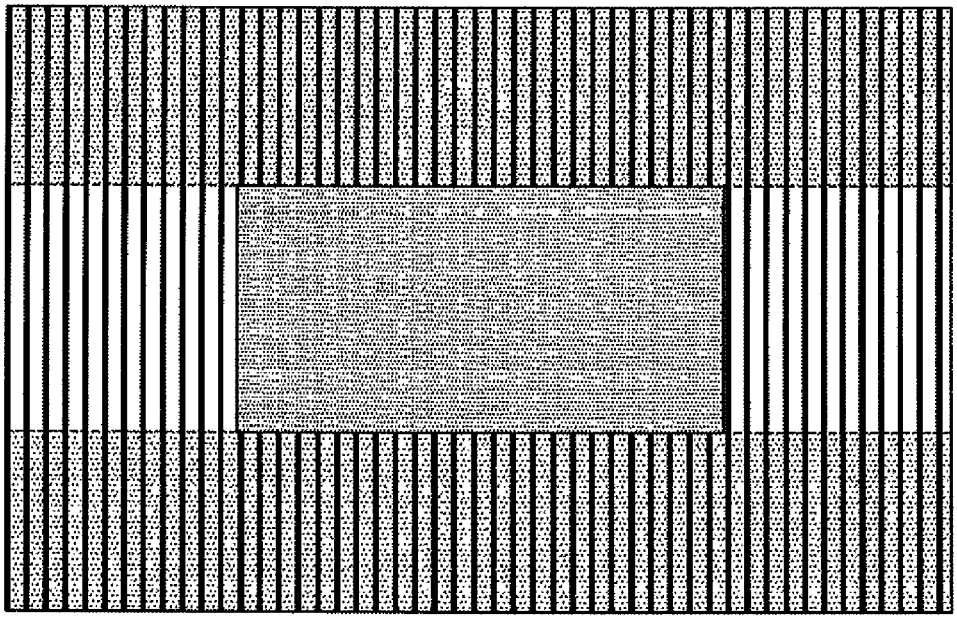
FIG. 1 (Related Art)
FIG. 1 shows a test pattern for conducting an experiment on crosstalk.
Figure 2:
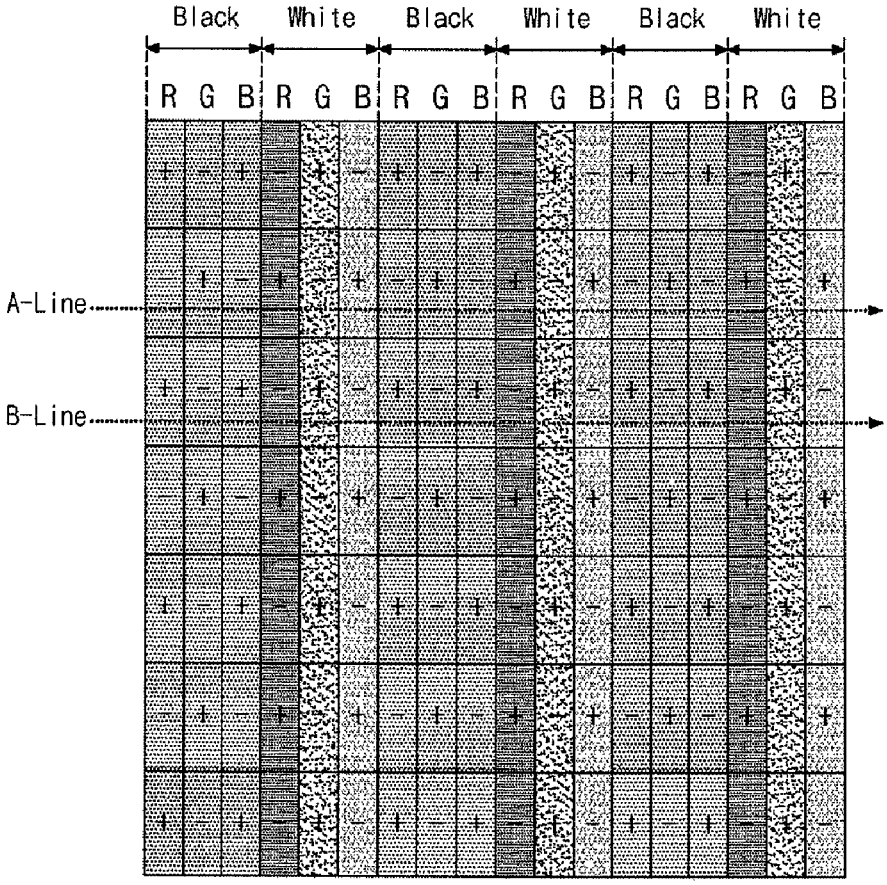
FIG. 2 (Related Art)
FIG. 2 shows a polarity of a data voltage in a portion of the test pattern of FIG. 1.
Figure 3:
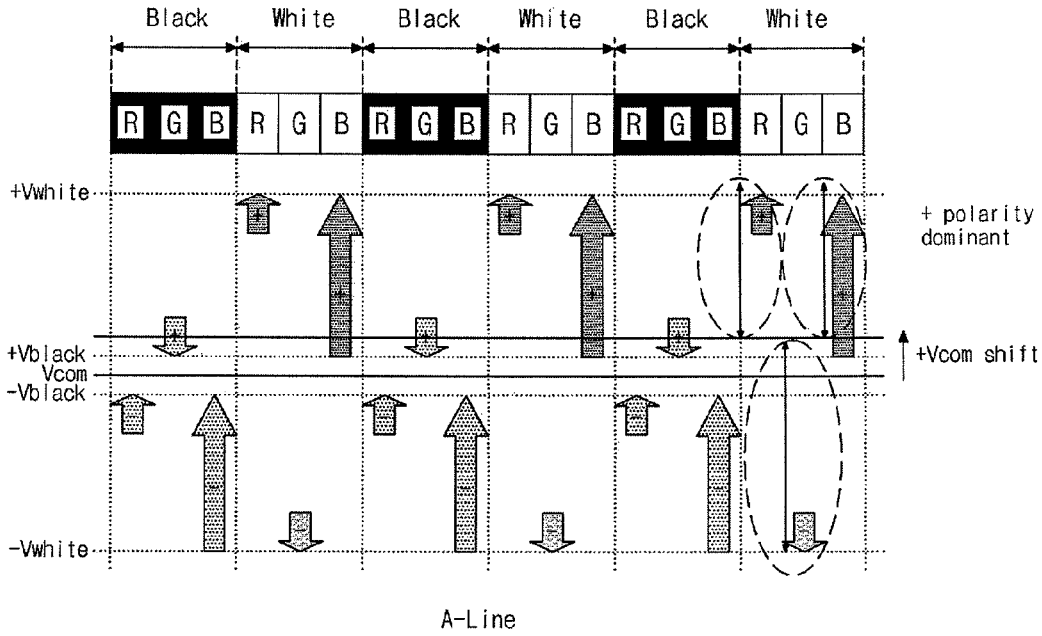
FIG. 3 (Related Art)
FIG. 3 shows a polarity of a data voltage in A-line shown in FIG. 2.
Figure 4:
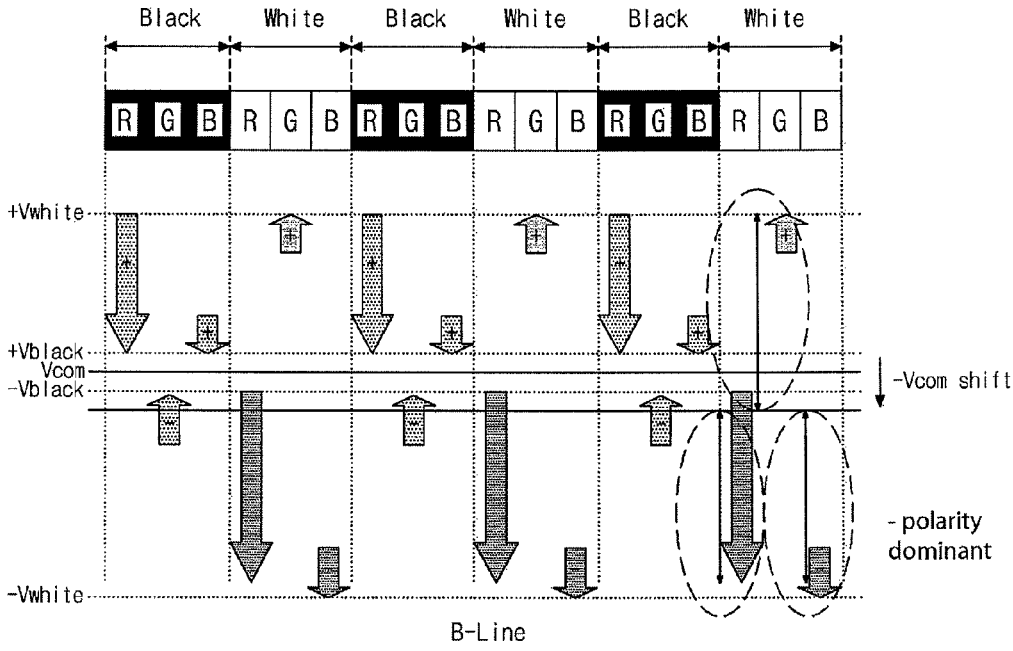
FIG. 4 (Related Art)
FIG. 4 shows a polarity of a data voltage in B-line shown in FIG. 2.
Figure 5:
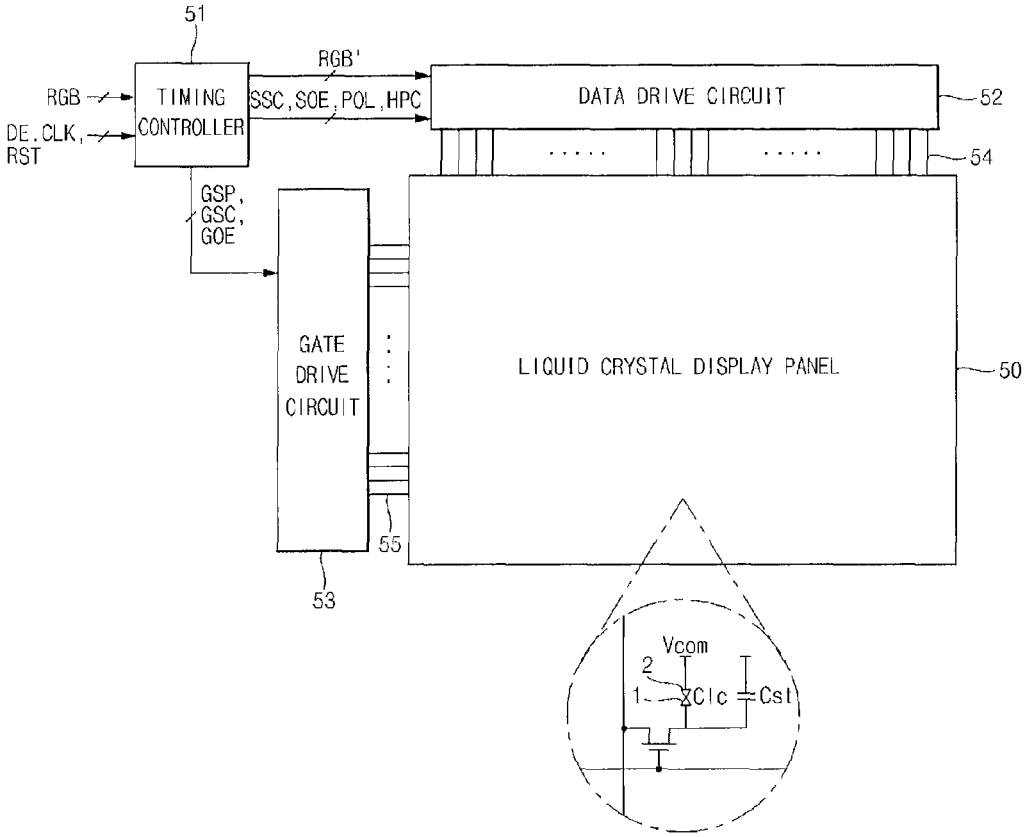
FIG. 5 is a block diagram of a liquid crystal display according to an exemplary embodiment of the invention.

As shown in FIG. 5, a liquid crystal display according to an exemplary embodiment of the invention includes a liquid crystal display panel 50, a timing controller 51, a data drive circuit 52, and a gate drive circuit 53. The data drive circuit 52 includes a plurality of source driver integrated circuits (ICs), and the gate drive circuit 53 includes a plurality of gate driver ICs.

The liquid crystal display panel 50 includes an upper glass substrate, a lower glass substrate, and a liquid crystal layer between the upper and lower glass substrates. The liquid crystal display panel 50 includes liquid crystal cells Clc arranged in a matrix format at each crossing of data lines 54 and gate lines 55.

The data lines 54, the gate lines 55, thin film transistors (TFTs), and a storage capacitor Cst are formed on the lower glass substrate of the liquid crystal display panel 50. The liquid crystal cells Clc are connected to the TFTs and driven by an electric field between pixel electrodes 1 and common electrodes 2. A black matrix, a color filter, and the common electrodes 2 are formed on the upper glass substrate of the liquid crystal display panel 50. The common electrode 2 is formed on the upper glass substrate in a vertical electric field drive manner, such as a twisted nematic (TN) mode and a vertical alignment (VA) mode. The common electrode 2 and the pixel electrode 1 are formed on the lower glass substrate in a horizontal electric field drive manner, such as an in-plane switching (IPS) mode and a fringe field switching (FFS) mode. Polarizing plates are attached respectively to the upper and lower glass substrates of the liquid crystal display panel 50. Alignment layers for setting a pre-tilt angle of liquid crystal are respectively formed on the upper and lower glass substrates.

The timing controller 51 supplies digital video data RGB' to the data drive circuit 52. The timing controller 51 receives timing signals such as a data enable signal DE and a dot clock signal CLK and generates control signals for controlling operation timing of the data drive circuit 52 and operation timing of the gate drive circuit 53. The control signals include a gate timing control signal for controlling operation timing of the gate drive circuit 53, a data timing control signal for controlling operation timing of the data drive circuit 52 and a vertical polarity of the data voltage, and a horizontal polarity conversion signal HPC for controlling a horizontal polarity of the data voltage. The timing controller 51 compares input data with a previously stored critical value, decides data whose polarities lean, and inverts the horizontal polarity conversion signal HPC in the data whose the polarities lean.

The gate timing control signal includes a gate start pulse GSP, a gate shift clock signal GSC, a gate output enable signal GOE, and the like. The gate start pulse GSP is applied to the first gate driver IC generating a first gate pulse and controls the first gate driver IC so as to generate the first gate pulse. The gate shift clock signal GSC is a clock signal commonly input to the gate driver ICs and a clock signal for shifting the gate start pulse GSP. The gate output enable signal GOE controls an output of the gate driver ICs.

The data timing control signal includes a source sampling clock signal SSC, a polarity control signal POL, and a source output enable signal SOE. The source sampling clock signal SSC is a clock signal controlling a sampling operation of data inside the data drive circuit 52 based on a rising or falling edge. The polarity control signal POL controls a vertical polarity of the data voltage output from the data drive circuit 52. The source output enable signal SOE controls an output of the data drive circuit 52.

Figure 13:
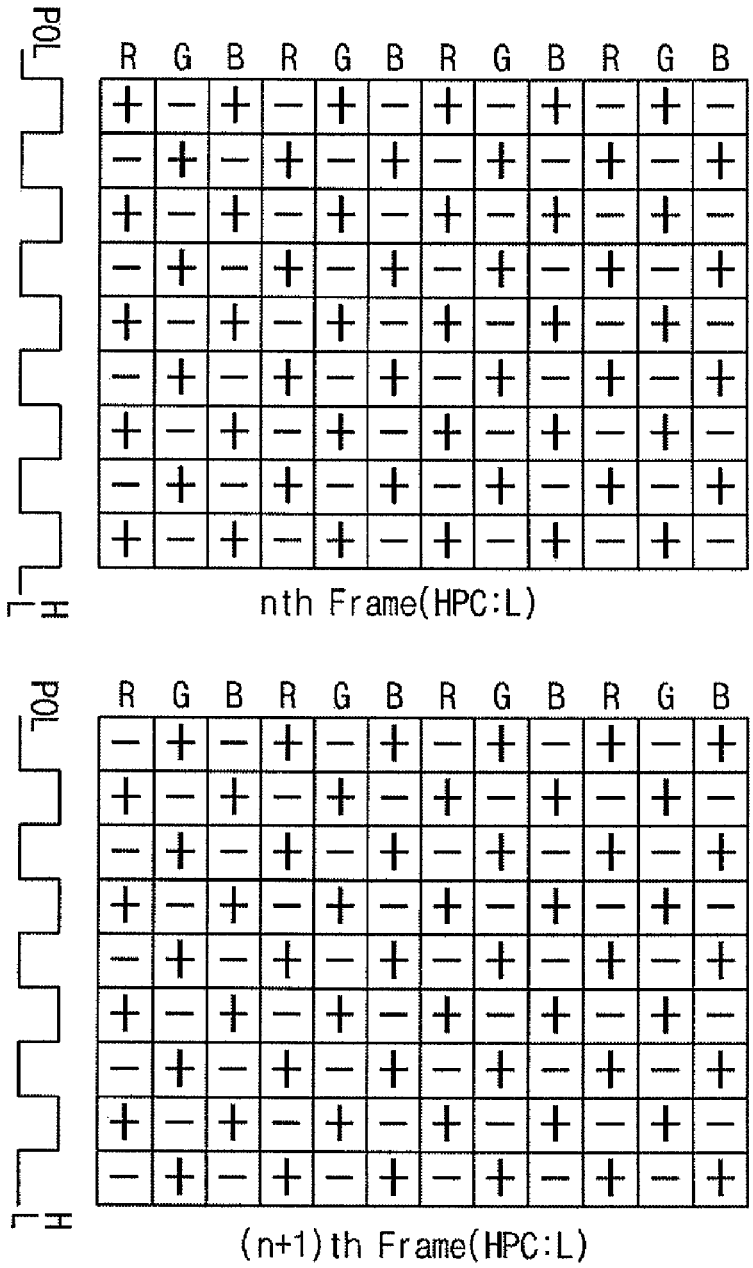
FIG. 13 shows polarities of the data voltages according to a horizontal 1 dot inversion scheme applied when a horizontal polarity conversion signal is generated in a low logic state.
Figure 14:
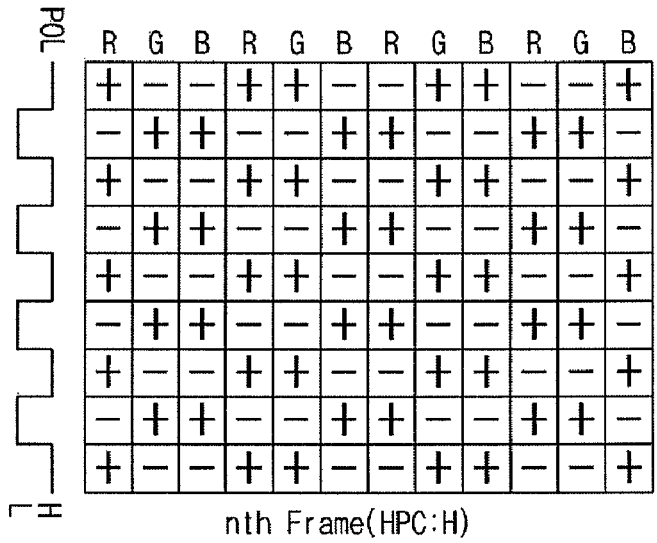
FIG. 14 shows polarities of the data voltages according to a horizontal 2 dot inversion scheme applied FI when a horizontal polarity conversion signal is generated in a high logic state.
Figure 14:
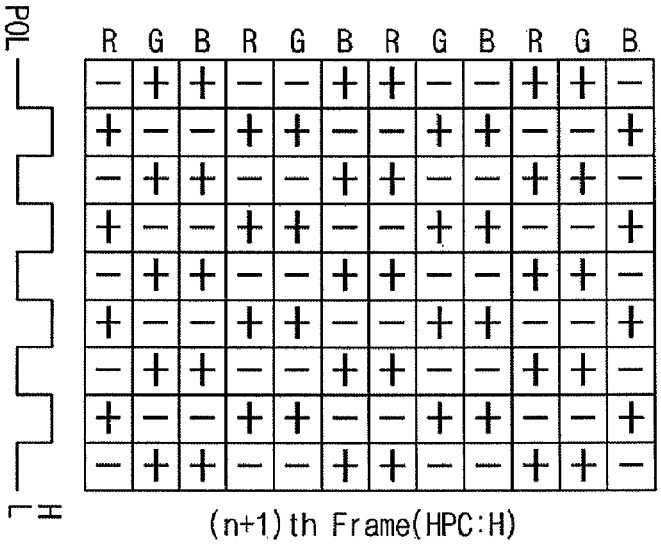

The horizontal polarity conversion signal HPC is generated in a low logic state when the data voltages whose polarities do not lean to any one polarity are input to the liquid crystal display panel 50. On the contrary, the horizontal polarity conversion signal HPC is generated in a high logic state when the data voltages whose polarities may lean to any one polarity are input to the liquid crystal display panel 50. If the horizontal polarity conversion signal HPC is generated in the low logic state, the data drive circuit 52 inverts polarities of the data voltages output through neighboring output channels according to a horizontal 1 dot inversion scheme. If the horizontal polarity conversion signal HPC is generated in the high logic state, the data drive circuit 52 inverts polarities of the data voltages output through neighboring output channels according to a horizontal 2 dot inversion scheme. In the horizontal 1 dot inversion scheme, polarities of the neighboring data voltages in a horizontal direction are inverted every 1 dot (or every 1 liquid crystal cell) as shown in FIG. 13. In the horizontal 2 dot inversion scheme, polarities of the neighboring data voltages in a horizontal direction are inverted every 2 dots (or every 2 liquid crystal cells) as shown in FIG. 14.

Each of the data driver ICs of the data drive circuit 52 includes a shift resistor, a latch, a digital-to-analog converter, an output buffer, and the like. The data drive circuit 52 latches the digital video data RGB' under the control of the timing controller 51. Then, the data drive circuit 52 converts the digital video data RGB' into analog positive and negative gamma compensation voltages in response to the polarity control signal POL, generates the analog positive and negative gamma compensation voltages, and supplies the analog positive and negative gamma compensation voltages to the data lines 54. The data drive circuit 52 controls a polarity inversion period of the neighboring data voltages in a horizontal direction in response to the horizontal polarity conversion signal HPC.

The gate drive circuit 53 sequentially supplies gate pulses to the gate lines 55 in response to the gate timing control signals. The gate driver ICs of the gate drive circuit 53 have a configuration shown in FIG. 7.

Figure 6:
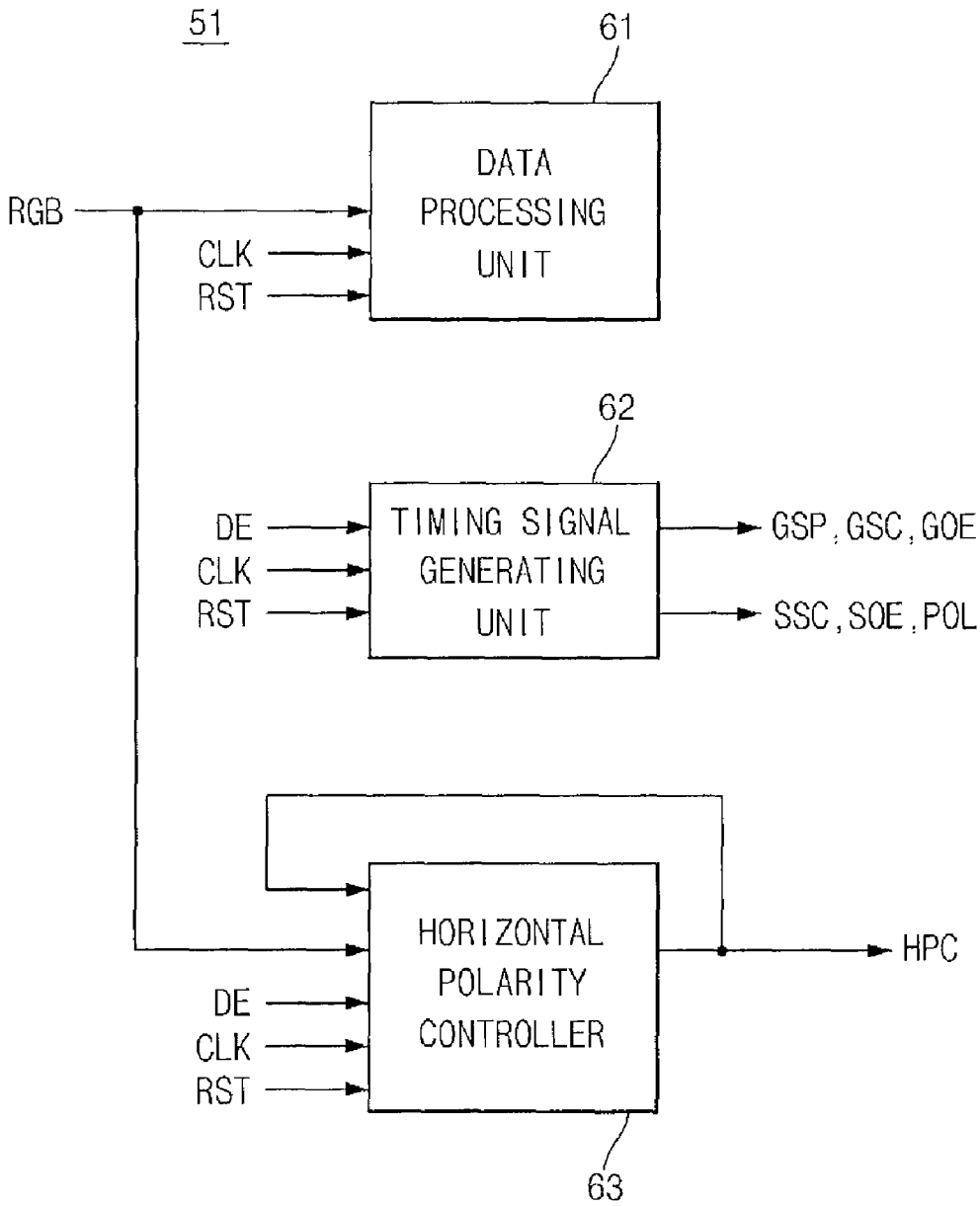
FIG. 6 is a block diagram of a timing controller shown in FIG.5.

FIG. 6 is a block diagram of the timing controller 51.

As shown in FIG. 6, the timing controller 51 includes a data processing unit 61, a gate/data timing signal generating unit 62, and a horizontal polarity controller 63.

The data processing unit 61 samples input digital video data RGB in response to the dot clock signal CLK and transmits the digital video data RGB' and mini LVDS (low-voltage differential signaling) clock to the data drive circuit 52 in a mini LVDS manner.

The gate/data timing signal generating unit 62 counts the data enable signal DE in response to the dot clock signal CLK and generates the gate timing control signal and the data timing control signal.

The horizontal polarity controller 63 receives the digital video data RGB, the feedback horizontal polarity conversion signal HPC, the data enable signal DE, the dot clock signal CLK, and the like, and finds polarities of the digital video data equal to or larger than a previously stored first critical value on each line based on the horizontal 1 dot inversion scheme. The horizontal polarity controller 63 decides the line in which a difference between a positive polarity data count of the digital video data and a negative polarity data count of the digital video data is equal to or larger than a previously stored second critical value, as an unbalanced line in which the polarities of the data lean to any one polarity. If the number of unbalanced lines on one screen is smaller than a previously stored third critical value, the horizontal polarity controller 63 generates the horizontal polarity conversion signal HPC in a low logic state so as to control polarities of the data voltages output from the data drive circuit 52 according to the horizontal 1 dot inversion scheme. If the number of unbalanced lines on one screen is equal to or larger than the third critical value, the horizontal polarity controller 63 generates the horizontal polarity conversion signal HPC in a high logic state so as to control polarities of the data voltages output from the data drive circuit 52 according to the horizontal 2 dot inversion scheme.

Figure 7:
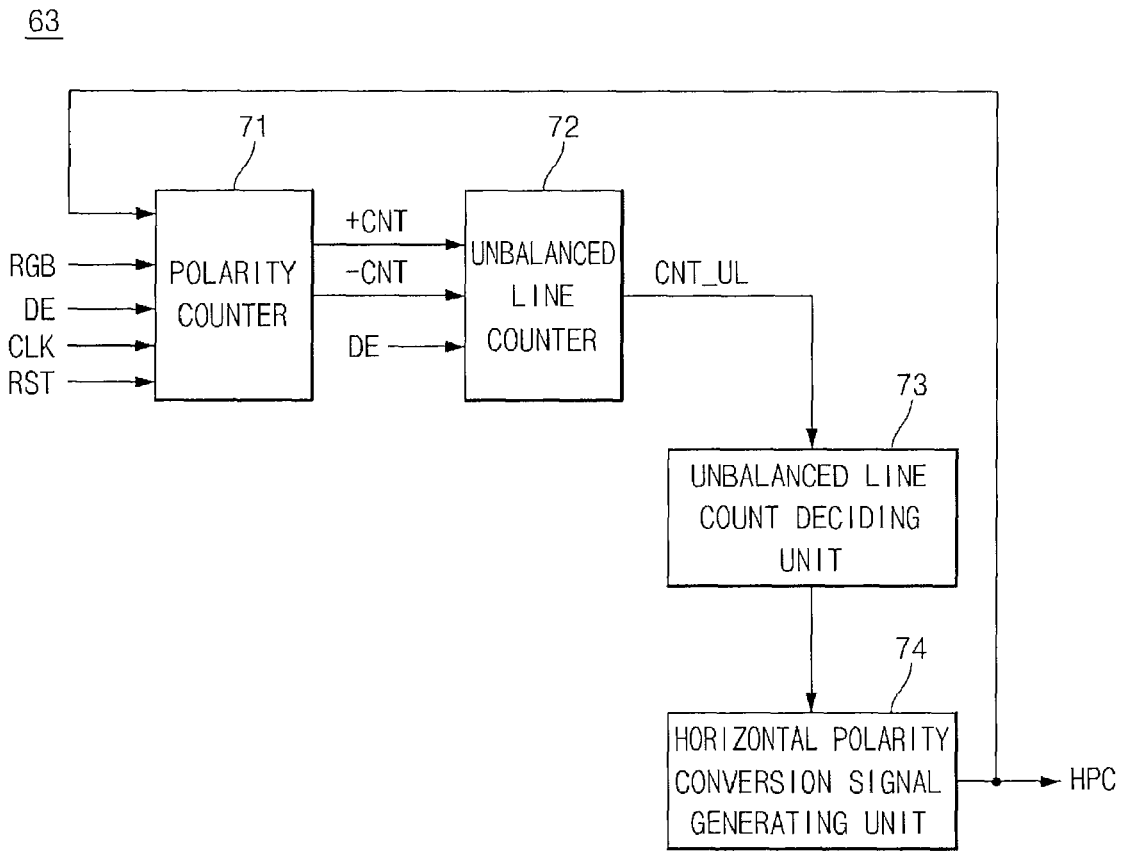
FIG. 7 is a block diagram of a horizontal polarity controller shown in FIG. 6.

FIG. 7 is a block diagram of the horizontal polarity controller 63.

As shown in FIG. 7, the horizontal polarity controller 63 includes a polarity counter 71, an unbalanced line counter 72, an unbalanced line count deciding unit 73, and a horizontal polarity conversion signal generating unit 74.

The polarity counter 71 compares the input digital video data RGB with the first critical value and extracts the input digital video data RGB equal to or larger than the first critical value. The first critical value may be selected as a value capable of extracting the input digital video data RGB equal to or larger than an intermediate gray level. For example, if the liquid crystal display panel 50 can display data with 256 gray values of 0 to 255 by 8-bit digital video data, most significant 2-bit of digital video data with 64 to 255 gray levels is '01', '10', and '11'. In this case, the first critical value may be determined as '01'. The polarity counter 71 compares the most significant bit of the input digital video data RGB with the first critical value, but may compare the input digital video data RGB with the first critical value in units of full-bit. For example, the first critical value can be determined as '01000000' corresponding to 64 gray levels. The polarity counter 71 compares the input digital video data RGB with the first critical value and extracts the digital video data RGB equal to or larger than the first critical value. The polarity counter 71 counts the number of data, which will be supplied to the liquid crystal display panel 50 as a positive data voltage, and the number of data, which will be supplied to the liquid crystal display panel 50 as a negative data voltage, among the extracted digital video data based on a polarity pattern of the horizontal 1 dot inversion scheme. Then, the polarity counter 71 outputs a positive polarity data count +CNT and a negative polarity data count −CNT accumulated inside 1 data enable signal DE indicating an effective data period to be displayed on each line of the liquid crystal display panel 50. A counter value of the polarity counter 71 is reset within a blanking period of 1 data enable signal DE.

The unbalanced line counter 72 calculates a difference between the positive polarity data count +CNT and the negative polarity data count −CNT received from the polarity counter 71 and compares the difference value with the second critical value. The second critical value may be determined as a value corresponding to 50% of the total number of data on 1 line. For example, because the total number of data on 1 line in the XGA resolution is 3072 (=1024 (the number of pixels)× 3(RGB)), the second critical value may be determined as 1536. The unbalanced line counter 72 counts a line, in which the difference between the positive polarity data count +CNT and the negative polarity data count −CNT is equal to or larger than the second critical value, as the unbalanced line to output a unbalanced line count CNT_UL. The unbalanced line count CNT_UL is reset every 1 frame period.

The unbalanced line count deciding unit 73 compares the unbalanced line count CNT_UL accumulated during 1 frame period with the third critical value. The third critical value is selected as N, where N is a positive integer equal to or smaller than the number of horizontal resolution lines of the liquid crystal display panel 50. For example, the third critical value may be selected as an integer between 10 and 50, but is not limited thereto. The third critical value may change depending on the resolution or the image quality of the liquid crystal display panel 50. The unbalanced line count deciding unit 73 generates a control signal whose a logic state is inverted depending on the number of unbalanced lines and controls an output of the horizontal polarity conversion signal generating unit 74 in response to the control signal.

The horizontal polarity conversion signal generating unit 74 generates the horizontal polarity conversion signal HPC in a high logic state when the number of unbalanced lines during 1 frame period is equal to or larger than the third critical value. The horizontal polarity conversion signal generating unit 74 generates the horizontal polarity conversion signal HPC in a low logic state when the number of unbalanced lines during 1 frame period is smaller than the third critical value. The data drive circuit 52 inverts polarities of the data voltages according to the 1 dot inversion scheme in response to the horizontal polarity conversion signal HPC of the low logic state, and inverts polarities of the data voltages according to the 2 dot inversion scheme in response to the horizontal polarity conversion signal HPC of the high logic state.

Figure 8:
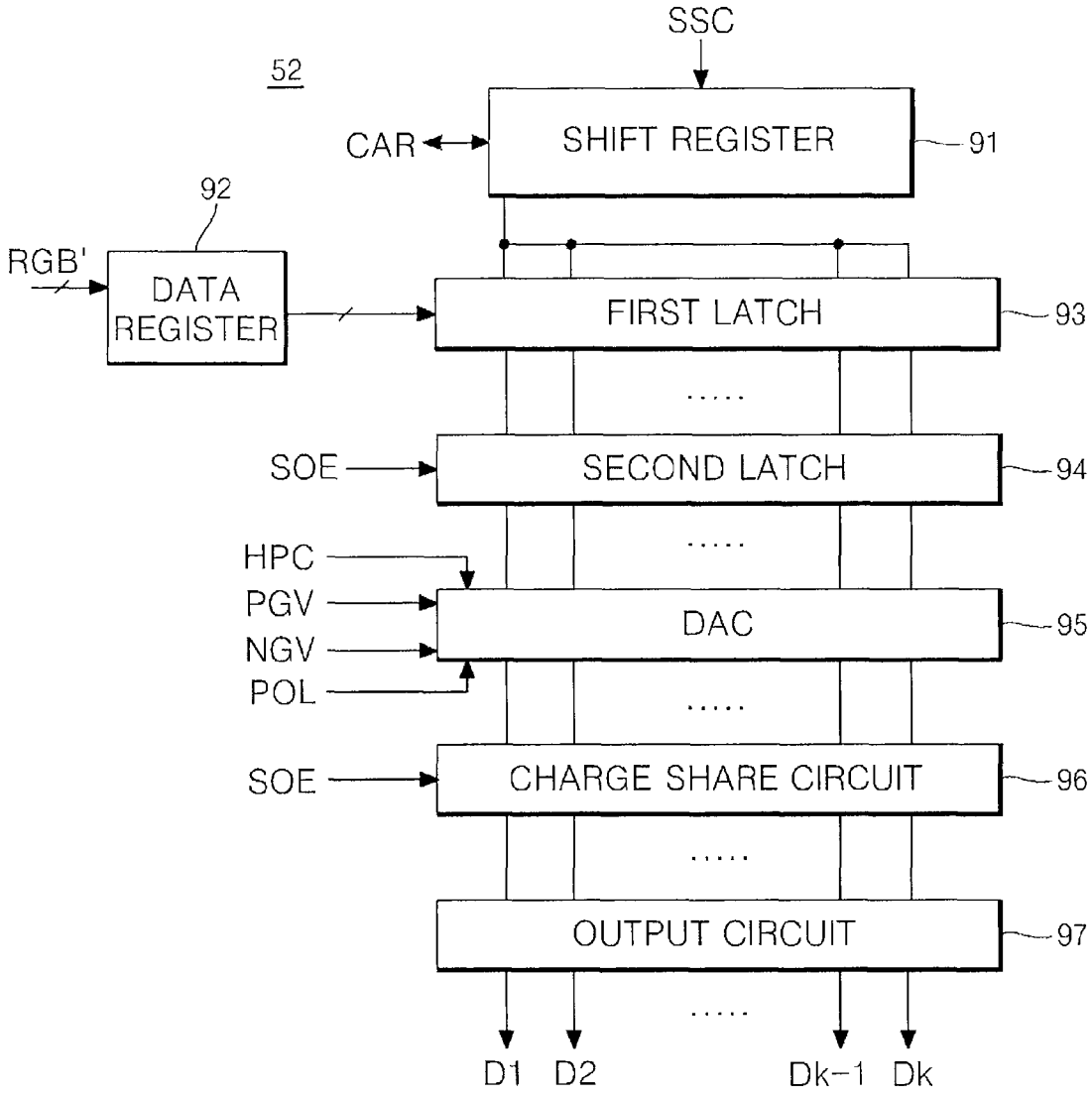
FIG. 8 is a block diagram of a source driver integrated circuit (IC) of a data drive circuit shown in FIG. 5.

FIG. 8 is a block diagram of the source driver IC of the data drive circuit 52.

As shown in FIG. 8, each of the source driver ICs of the data drive circuit 52 drives k data lines D1 to Dk, where k is a positive integer. For this, each source driver IC includes a shift register 91, a data register 92, a first latch 93, a second latch 94, a digital-to-analog converter (DAC) 95, a charge share circuit 96, and an output circuit 97.

The shift register 91 generates a sampling signal in response to the source sampling clock signal SSC. The shift register 91 transmits a carry signal CAR from a source driver IC to a next source driver IC. The data register 92 temporarily stores the digital video data RGB' received from the timing controller 51 and supplies the digital video data RGB' to the first latch 93. The first latch 93 samples the digital video data RGB' supplied by the data register 92 in response to the sampling signals that are sequentially output from the shift register 91, latches the digital video data RGB', and simultaneously outputs the digital video data. The second latch 94 latches the digital video data output from the first latch 93, and then the second latch 94 of one source driver IC and the second latches 94 of the other source driver Ics simultaneously outputs the digital video data during a low logic period of the source output enable signal SOE.

The DAC 95 converts the digital video data output from the second latch 94 into a positive gamma compensation voltage PGV or a negative gamma compensation voltage NGV in response to the polarity control signal POL and the horizontal polarity conversion signal HPC to output analog positive/negative data voltages.

The charge share circuit 96 shorts out neighboring data output channels during a high logic period of the source output enable signal SOE to output an average value of the neighboring data voltages as a charge share voltage, or supplies the common voltage Vcom to data output channels during a high logic period of the source output enable signal SOE to reduce a sharp difference between the positive data voltage and the negative data voltage.

The output circuit 97 includes a buffer and minimizes signal attenuation of the analog data voltages supplied to the k data lines D1 to Dk.

Figure 9:
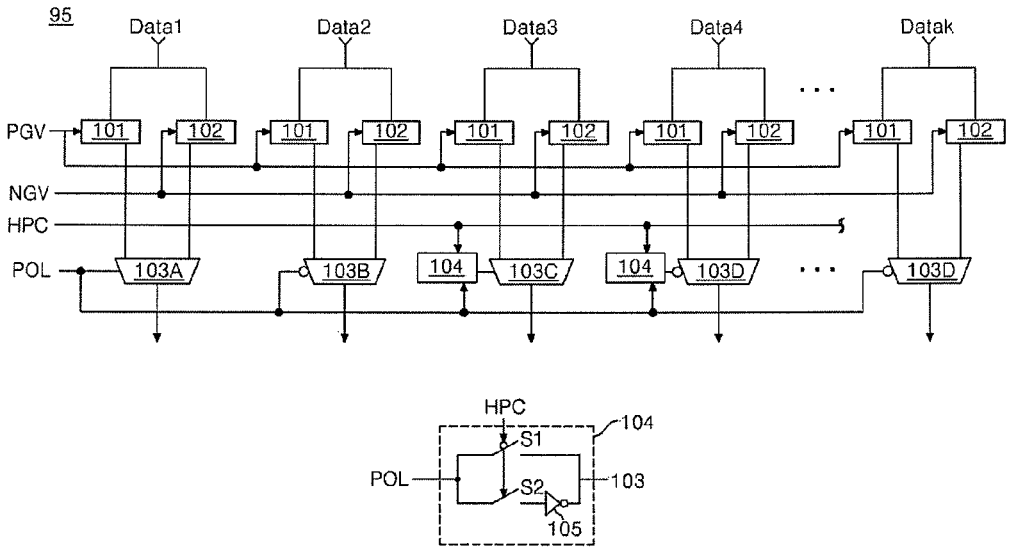
FIG. 9 is a circuit diagram of a digital-to-analog converter shown in FIG. 8.

FIG. 9 is a circuit diagram of the DAC 95.

As shown in FIG. 9, the DAC 95 includes a P-decoder 101, an N-decoder 102, multiplexers 103A to 103D, and a horizontal output inversion circuit 104.

The P-decoder 101 converts digital video data DATA1 to DATAk into the positive gamma compensation voltage PGV to generate the analog positive data voltage. The N-decoder 102 converts the digital video data DATA1 to DATAk into the negative gamma compensation voltage NGV to generate the analog negative data voltage.

The (4i+1)-th multiplexer 103A alternately selects the analog positive data voltage and the analog negative data voltage every 1 horizontal period in response to the polarity control signal POL input to a non-inverting control terminal of the multiplexer 103A. The (4i+2)-th multiplexer 103B alternately selects the analog positive data voltage and the analog negative data voltage every 1 horizontal period in response to the polarity control signal POL input to an inverting control terminal of the multiplexer 103B. The (4i+3)-th multiplexer 103C alternately selects the analog positive data voltage and the analog negative data voltage every 1 horizontal period in response to an output of the horizontal output inversion circuit 104 input to a non-inverting control terminal of the multiplexer 103C. The (4i+4)-th multiplexer 103D alternately selects the analog positive data voltage and the analog negative data voltage every 1 horizontal period in response to an output of the horizontal output inversion circuit 104 input to an inverting control terminal of the multiplexer 103D.

The horizontal output inversion circuit 104 controls the (4i+3)-th and (4i+4)-th multiplexers 103C and 103D in response to the horizontal polarity conversion signal HPC and controls a polarity inversion period of the data voltage in a horizontal direction depending on the horizontal polarity conversion signal HPC. The horizontal output inversion circuit 104 includes first and second switches S1 and S2 and an inverter 105. The polarity control signal POL is supplied to an input terminal of the first switch S1, and an output terminal of the first switch S1 is connected to the non-inverting control terminal of the (4i+3)-th multiplexer 103C or the inverting control terminal of the (4i+4)-th multiplexer 103D. The horizontal polarity conversion signal HPC is supplied to an inverting control terminal of the first switch S1. The polarity control signal POL is supplied to an input terminal of the second switch S2, and an output terminal of the second switch S2 is connected to the inverter 105. The horizontal polarity conversion signal HPC is supplied to a non-inverting control terminal of the second switch S2. The inverter 105 is connected to the output terminal of the second switch S2 and the non-inverting control terminal of the (4i+3)-th multiplexer 103C or the inverting control terminal of the (4i+4)-th multiplexer 103D to selectively invert the polarity control signal POL depending on the horizontal polarity conversion signal HPC.

If the horizontal polarity conversion signal HPC is generated in a high logic state, the second switch S2 is turned on and the first switch S1 is turned off. Hence, the polarity control signal POL inverted by the inverter 105 is input to the non-inverting control terminal of the (4i+3)-th multiplexer 103C, and at the same time, the polarity control signal POL inverted by the inverter 105 is input to the inverting control terminal of the (4i+4)-th multiplexer 103D.

If the horizontal polarity conversion signal HPC is generated in a low logic state, the first switch S1 is turned on and the second switch S2 is turned off. Hence, the polarity control signal POL is input to the non-inverting control terminal of the (4i+3)-th multiplexer 103C, and at the same time, the polarity control signal POL is input to the inverting control terminal of the (4i+4)-th multiplexer 103D.

Accordingly, if the horizontal polarity conversion signal HPC is generated in a low logic state, data supplied to the (4i+1)-th to (4i+4)-th data lines, as shown in FIG. 13, has a horizontal polarity pattern of "+−+−" during an n-th frame period and has a horizontal polarity pattern of "−+−+" during an (n+1)-th frame period. On the contrary, if the horizontal polarity conversion signal HPC is generated in a high logic state, data supplied to the (4i+1)-th to (4i+4)-th data lines, as shown in FIG. 14, has a horizontal polarity pattern of "+−−+"

during the n-th frame period and has a horizontal polarity pattern of "−++−" during the (n+1)-th frame period.

Figure 10:
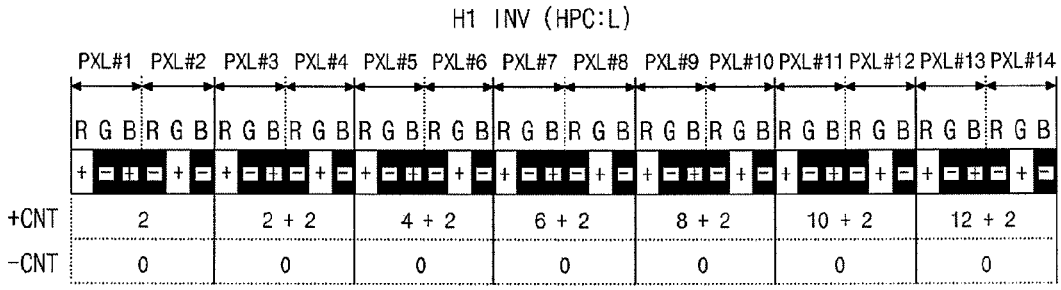
FIG. 10 shows an example of a polarity count of data equal to or lager than a first critical value when polarities of data voltages change based on a horizontal 1 dot inversion scheme.

FIG. 10 shows an example of a polarity count of data equal to or lager than the first critical value when polarities of the data voltages change based on the horizontal 1 dot inversion scheme.

Supposing that the digital video data RGB is input according to a data pattern shown in FIG. 10 and polarities of the digital video data RGB change based on the horizontal 1 dot inversion scheme, polarities of the data voltages lean to a positive polarity.

In the data pattern shown in FIG. 10, data PXL#1, PXL#3, PXL#5, . . . , and PXL#13 on odd-numbered pixels include R data equal to or larger than the first critical value and G data and B data smaller than the first critical value. Data PXL#2, PXL#4, PXL#6, . . . , and PXL#14 on even-numbered pixels include G data equal to or larger than the first critical value and R data and B data smaller than the first critical value. In the data PXL#1 to PXL#14, all the data equal to or larger than the first critical value has a positive polarity according to a polarity pattern of the horizontal 1 dot inversion scheme, and the data smaller than the first critical value has a positive or negative polarity according to the polarity pattern of the horizontal 1 dot inversion scheme.

Because the timing controller 51 does not count the data smaller than the first critical value, when the 1st and 2nd pixel data PXL#1 and PXL#2 is input, the timing controller 51 increases the positive polarity data count +CNT by 2 and does not increase the negative polarity data count −CNT. When the 3rd and 4th pixel data PXL#3 and PXL#4 is input, the timing controller 51 increases the positive polarity data count +CNT by 2 and does not increase the negative polarity data count −CNT. When the 5th and 6th pixel data PXL#5 and PXL#6 is input, the timing controller 51 increases the positive polarity data count +CNT by 2 and does not increase the negative polarity data count −CNT. After the above counting operation is continuously performed, in the 14th pixel data PXL#14, the positive polarity data count +CNT increases to 14, and the negative polarity data count −CNT is 0. If the data pattern shown in FIG. 10 is input, the difference between the positive polarity data count +CNT and the negative polarity data count −CNT is equal to or larger than the second critical value, and the number of unbalanced lines on one screen is equal to or larger than the third critical value, the timing controller 51 decides the data pattern input during a current frame period as a data pattern in which polarities of the data may lean to any one polarity. In this case, the timing controller 51 inverts the horizontal polarity conversion signal HPC generated during the current frame period, and then controls horizontal polarities of the data voltages during a next frame period in the horizontal 2 dot inversion scheme as shown in FIG. 11.

Figure 11:
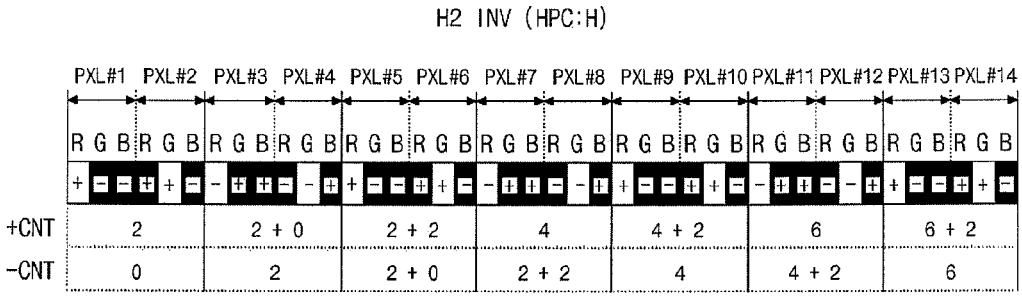
FIG. 11 shows an example of a polarity count of data equal to or lager than a first critical value when polarities of data voltages in a data pattern shown in FIG. 10 change based on a horizontal 1 dot inversion scheme

As shown in FIG. 11, the timing controller 51 generates the horizontal polarity conversion signal HPC in a high logic state when the data pattern shown in FIG. 10 is input. Accordingly, the 1st, 2nd, 5th, 6th, 9th, 10th, 13th, and 14th pixel data PXL#1, PXL#2, PXL#5, PXL#6, PXL#9, PXL#10, PXL#13, and PXL#14 include the R data and the G data equal to or larger than the first critical value that may be converted into the positive data voltage. On the contrary, the 3rd, 4th, 7th, 8th, 11th, and 12th pixel data PXL#3, PXL#4, PXL#7, PXL#8, PXL#11, and PXL#12 include the R data and the G data equal to or larger than the first critical value that may be converted into the negative data voltage.

Because the timing controller 51 does not count the data smaller than the first critical value, when the 1st and 2nd pixel data PXL#1 and PXL#2 is input, the timing controller 51 increases the positive polarity data count +CNT by 2 and does not increase the negative polarity data count −CNT. When the 3rd and 4th pixel data PXL#3 and PXL#4 is input, the timing controller 51 does not increase the positive polarity data count +CNT and increases the negative polarity data count −CNT by 2. When the 5th and 6th pixel data PXL#5 and PXL#6 is input, the timing controller 51 further increases the positive polarity data count +CNT by 2 and does not increase the negative polarity data count −CNT. When the 7th and 8th pixel data PXL#7 and PXL#8 is input, the timing controller 51 does not increase the positive polarity data count +CNT and further increases the negative polarity data count −CNT by 2. If the digital video data of the line shown in FIG. 11 is converted into the data voltages that will be supplied to the liquid crystal display panel 50, polarities of the data voltages do not lean to any one polarity. Accordingly, the common voltage in the line shown in FIG. 11 is not shifted, and a greenish phenomenon does not appear.

Figure 12:
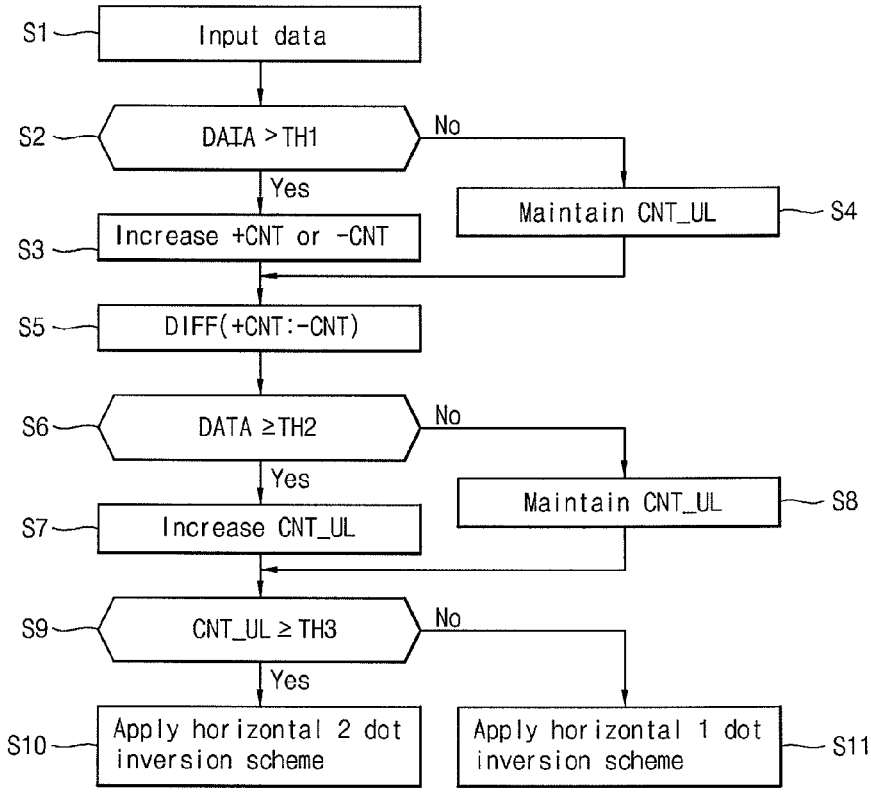
FIG. 12 is a flow chart showing a method of driving the liquid crystal display according to the exemplary embodiment of the invention.

FIG. 12 is a flow chart showing a method of driving the liquid crystal display according to the exemplary embodiment of the invention.

As shown in FIG. 12, the method of driving the liquid crystal display according to the exemplary embodiment of the invention compares input digital video data with a first critical value TH1 in steps S1 and S2.

The method counts polarities of the digital video data equal to larger than the first critical value TH1 based on the horizontal 1 dot inversion scheme in step S3. The method does not count polarities of the digital video data smaller than the first critical value TH1 in step S4.

The method calculates a difference between a positive polarity data count +CNT and a negative polarity data count −CNT in each horizontal line of the liquid crystal display panel 50, and then compares the difference value DIFF(+CNT:−CNT) with a second critical value TH2 in steps S5 and S6. The method decides the horizontal line, in which the difference value DIFF(+CNT:−CNT) is equal to or larger than the second critical value TH2, as an unbalanced line and increase an unbalanced line count CNT_UL in step S7. In step S8, the unbalanced line count CNT_UL does not increase in the horizontal line, in which the difference value DIFF(+CNT:−CNT) is smaller than the second critical value TH2.

The method compare the unbalanced line count CNT_UL accumulated during 1 frame period with the third critical value TH3 in step S9. If the unbalanced line count CNT_UL is equal to or larger than the third critical value TH3, the method generates the horizontal polarity conversion signal HPC in a high logic state to control polarities of the data voltages output from the data drive circuit 52 according to the horizontal 2 dot inversion scheme shown in FIG. 14 in step S10. On the country, if the unbalanced line count CNT_UL is smaller than the third critical value TH3, the method generates the horizontal polarity conversion signal HPC in a low logic state to control polarities of the data voltages output from the data drive circuit 52 according to the horizontal 1 dot inversion scheme shown in FIG. 13 in step S11. The data drive circuit 52 lengthens horizontal polarity inversion periods of the data voltages, that will be supplied to the data lines 54 of the liquid crystal display panel 50 during a next frame period, from the horizontal 1 dot inversion scheme to the horizontal 2 dot inversion scheme, or shortens the horizontal polarity inversion periods from the horizontal 2 dot inversion scheme to the horizontal 1 dot inversion scheme depending on the horizontal polarity conversion signal HPC.

As described above, the liquid crystal display and the method of driving the same according to the exemplary embodiment of the invention extracts data equal to or larger than a critical value, and controls a horizontal polarity inversion period of the data when the number of unbalanced lines is equal to or larger than a predetermined value, thereby solving a leaning phenomenon of the polarities. As a result, the liquid crystal display and the method of driving the same according to the exemplary embodiment of the invention can prevent the shift of a common voltage and the greenish phenomenon by preventing the polarity leaning phenomenon of the data, and also can improve the image quality.

It will be apparent to those skilled in the art that various modifications and variations can be made in the embodiments of the invention without departing from the spirit or scope of the invention. Thus, it is intended that embodiments of the invention cover the modifications and variations of this invention provided they come within the scope of the appended claims and their equivalents.

What is claimed is:

1. A liquid crystal display comprising:

a liquid crystal display panel including data lines and gate lines crossing each other, and liquid crystal cells arranged in a matrix format;

a horizontal polarity controller that compares digital video data with a critical value and inverts a logic state of a horizontal polarity conversion signal when polarities of the digital video data lean based on the comparative result;

a data drive circuit that converts the digital video data into positive and negative data voltages and controls horizontal polarity inversion periods of the data voltages in response to the horizontal polarity conversion signal; and a gate drive circuit that supplies scan signals to the gate lines, wherein the critical value includes:

a first critical value that is compared with the digital video data;

a second critical value that is compared with a difference between the number of data to be displayed as a positive data voltage and the number of data to be displayed as a negative data voltages among the digital video data equal to or larger than the first critical value; and a third critical value that is compared with the total number of unbalanced lines, in which the difference is equal to or larger than the second critical value, during one frame period, the unbalanced line being a line in which polarities of the data lean to any one polarity.

2. The liquid crystal display of claim 1, wherein the horizontal polarity conversion signal whose logic state is inverted controls the data drive circuit to control the horizontal polarity inversion periods of the data voltages during a next frame period.

3. The liquid crystal display of claim 1, wherein the horizontal polarity controller includes:

a polarity counter that extracts the digital video data equal to or larger than the first critical value from the digital video data, counts the number of positive data and the number of negative data among the extracted data, and outputs a positive polarity data count and a negative polarity data count;

an unbalanced line counter that calculates a difference between the positive polarity data count and the negative polarity data count in each horizontal line of the liquid crystal display panel, counts the horizontal line, in which the difference is equal to or larger than the second critical value, as the unbalanced line, and outputs an unbalanced line count;

an unbalanced line count deciding unit that when the unbalanced line count during one frame period is equal to or larger than the third critical value, generates a control signal for differently controlling horizontal polarity inversion periods of data to be displayed on the liquid crystal display panel; and a horizontal polarity conversion signal generating unit that inverts a logic state of the horizontal polarity conversion signal in response to the control signal.

4. The liquid crystal display of claim 1, wherein the data drive circuit lengthens horizontal polarity inversion periods of data voltages to be supplied to the data lines of the liquid crystal display panel during a next frame period in response to the horizontal polarity conversion signal.

5. The liquid crystal display of claim 4, wherein the data drive circuit lengthens the horizontal polarity inversion periods of the data voltages to be supplied to the data lines during the next frame period from a horizontal 1 dot inversion scheme to a horizontal 2 dot inversion scheme in response to the horizontal polarity conversion signal.

6. The liquid crystal display of claim 1, wherein the data drive circuit shortens horizontal polarity inversion periods of data voltages to be supplied to the data lines of the liquid crystal display panel during a next frame period in response to the horizontal polarity conversion signal.

7. The liquid crystal display of claim 6, wherein the data drive circuit shortens the horizontal polarity inversion periods of the data voltages to be supplied to the data lines during the next frame period from a horizontal 2 dot inversion scheme to a horizontal 1 dot inversion scheme in response to the horizontal polarity conversion signal.

8. A method of driving a liquid crystal display including a liquid crystal display panel including data lines and gate lines crossing each other and liquid crystal cells arranged in a matrix format, the method comprising:

comparing digital video data with a critical value and inverting a logic state of a horizontal polarity conversion signal when polarities of the digital video data lean based on the comparative result;

converting the digital video data into positive and negative data voltages and controlling horizontal polarity inversion periods of the data voltages in response to the horizontal polarity conversion signal; and supplying scan signals to the gate lines, wherein the critical value includes:

a first critical value that is compared with the digital video data;

a second critical value that is compared with a difference between the number of data to be displayed as a positive data voltage and the number of data to be displayed as a negative data voltages among the digital video data equal to or larger than the first critical value; and a third critical value that is compared with the total number of unbalanced lines, in which the difference is equal to or larger than the second critical value, during one frame period, the unbalanced line being a line in which polarities of the data lean to any one polarity.

9. The method of claim 8, wherein the horizontal polarity conversion signal whose the logic state is inverted controls the horizontal polarity inversion periods of the data voltages during a next frame period.

10. The method of claim 8, wherein inverting the logic state of the horizontal polarity conversion signal includes:

extracting the digital video data equal to or larger than the first critical value from the digital video data, counting the number of positive data and the number of negative data among the extracted data, and outputting a positive polarity data count and a negative polarity data count;

calculating a difference between the positive polarity data count and the negative polarity data count in each horizontal line of the liquid crystal display panel, counting the horizontal line, in which the difference is equal to or larger than the second critical value, as the unbalanced line, and outputting an unbalanced line count;

generating a control signal for differently controlling horizontal polarity inversion periods of data to be displayed on the liquid crystal display panel when the unbalanced line count during one frame period is equal to or larger than the third critical value; and inverting a logic state of the horizontal polarity conversion signal in response to the control signal.

11. The method of claim 8, wherein controlling the horizontal polarity inversion periods of the data voltages includes lengthening horizontal polarity inversion periods of data voltages to be supplied to the data lines of the liquid crystal display panel during a next frame period in response to the horizontal polarity conversion signal.

12. The method of claim 8, wherein controlling the horizontal polarity inversion periods of the data voltages includes shortening horizontal polarity inversion periods of data voltages to be supplied to the data lines of the liquid crystal display panel during a next frame period in response to the horizontal polarity conversion signal.

* * * * *